US007934361B2

(12) United States Patent
Tsuruta et al.

(10) Patent No.: US 7,934,361 B2
(45) Date of Patent: May 3, 2011

(54) PACKAGING APPARATUS

(75) Inventors: Orihiro Tsuruta, Takasaki (JP); Katsumi Nagai, Takasaki (JP); Kazumi Nakazato, Takasaki (JP)

(73) Assignee: Orihiro Engineering Co., Ltd., Takasaki-Shi, Gunma (JP)

( * ) Notice: Subject to any disclaimer, the term of this patent is extended or adjusted under 35 U.S.C. 154(b) by 44 days.

(21) Appl. No.: 12/089,854

(22) PCT Filed: Oct. 19, 2005

(86) PCT No.: PCT/JP2005/019193

§ 371 (c)(1),
(2), (4) Date: Apr. 10, 2008

(87) PCT Pub. No.: WO2007/046137

PCT Pub. Date: Apr. 26, 2007

(65) Prior Publication Data

US 2009/0277140 A1 Nov. 12, 2009

(51) Int. Cl.
*B65B 9/06* (2006.01)

(52) U.S. Cl. ..... 53/551; 53/451; 53/553

(58) Field of Classification Search ..... 53/450, 53/451, 548, 550, 551, 552, 553
See application file for complete search history.

(56) References Cited

U.S. PATENT DOCUMENTS

| | | | | | |
|---|---|---|---|---|---|
| 3,473,286 | A | * | 10/1969 | Henry | 53/411 |
| 4,106,261 | A | * | 8/1978 | Greenawalt | 53/449 |
| 4,479,283 | A | * | 10/1984 | Hollingsworth | 452/22 |
| 4,501,109 | A | * | 2/1985 | Monsees | 53/451 |
| 4,543,152 | A | * | 9/1985 | Nozaka | 156/502 |
| 4,722,489 | A | * | 2/1988 | Wommer | 242/552 |
| 4,848,691 | A | * | 7/1989 | Muto et al. | 242/553 |
| 4,995,936 | A | * | 2/1991 | Cohn | 156/504 |
| 5,388,387 | A | * | 2/1995 | McElvy | 53/451 |
| 5,971,905 | A | * | 10/1999 | Fukuda | 493/3 |
| 6,041,574 | A | * | 3/2000 | Bennett | 53/411 |
| 6,041,575 | A | * | 3/2000 | Vonderhorst et al. | 53/415 |
| 6,067,778 | A | * | 5/2000 | Yamamoto et al. | 53/451 |
| 6,079,188 | A | * | 6/2000 | Katayama et al. | 53/451 |
| 6,110,089 | A | * | 8/2000 | Hatozaki et al. | 493/189 |
| 6,321,510 | B2 | * | 11/2001 | Preisner et al. | 53/412 |

(Continued)

FOREIGN PATENT DOCUMENTS

JP 11-236002 8/1999

(Continued)

*Primary Examiner* — Paul R Durand
(74) *Attorney, Agent, or Firm* — Knobbe, Martens, Olson & Bear, LLP

(57) ABSTRACT

There is provided a packaging apparatus including a mechanism for joining a film from a film roll and a film from another film roll to each other. The packaging apparatus is capable of preventing a joint of the films from suffering a thermal sealing failure thereby increasing production efficiency. Package apparatus (10) includes film supply mechanism (10A) for joining and supplying films (1A, 1B) and packaging mechanism (10C) for producing package bags from the film. Film accumulator (10B) for guiding and holding the film in a meandering fashion is disposed between film supply mechanism (10A) and packaging mechanism (10C). Some of accumulating rollers (21) of film accumulator (10B) are movable to a predetermined position depending on the size of package bags to be manufactured. The length of the film from a position in which the films are joined to each other to a position in which the film is horizontally sealed is changed to prevent the joint between the films from being placed in the position in which the film is horizontally sealed.

9 Claims, 12 Drawing Sheets

U.S. PATENT DOCUMENTS

| | | | | |
|---|---|---|---|---|
| 6,378,277 | B1 * | 4/2002 | Inoue et al. | 53/64 |
| 6,574,939 | B1 * | 6/2003 | Heijnen et al. | 53/133.4 |
| 6,631,605 | B1 * | 10/2003 | Quintin et al. | 53/451 |
| 6,923,880 | B2 * | 8/2005 | Keene et al. | 156/159 |
| 6,957,523 | B2 * | 10/2005 | Siccardi | 53/425 |
| 7,003,934 | B1 * | 2/2006 | Yano | 53/552 |
| 7,559,184 | B2 * | 7/2009 | Grzonka et al. | 53/551 |
| 2005/0061846 | A1 * | 3/2005 | Seaberg et al. | 226/118.3 |
| 2005/0069230 | A1 * | 3/2005 | Takahashi et al. | 383/104 |
| 2006/0000188 | A1 * | 1/2006 | Nikoley et al. | 53/64 |

FOREIGN PATENT DOCUMENTS

| | | |
|---|---|---|
| JP | 2004-001870 | 1/2004 |
| JP | 2004-217215 | 8/2004 |

* cited by examiner

PACKAGING APPARATUS

TECHNICAL FIELD

The present invention relates to a packaging apparatus for manufacturing a package bag filled with content such as a liquid, a viscous substance, or the like, from an elongate film reeled out from a film roll.

BACKGROUND ART

Heretofore, there has been known a filling packaging apparatus (hereinafter referred to simply as "packaging apparatus") for continuously producing packaged products (package bags) filled with content such as a liquid, a viscous substance, or the like, for example. Generally, the packaging apparatus manufactures package bags by folding a film in the form of an elongate sheet reeled out from a film roll, into a tubular form, and feeding the content into the film and forming sealed regions on the film.

FIG. 1 shows a film reeled out from a film roll. As shown in FIG. 1A, end marks A are normally applied in advance to a terminal end portion of the film that is wound on the film roll for indicating the end of the film. End marks A are regions where aluminum foil tapes or vinyl tapes are applied, for example. The packaging apparatus uses an optical sensor or the like for detecting these marks to stop the packaging operation. The film also has, in addition to end marks A, a plurality of registration marks C disposed at a given pitch which is established depending on the size (lengthwise dimension) of package bags to be manufactured.

Actually, the film that is wound on film roll R comprises a plurality of joined films of a predetermined length. As shown in FIG. 1B, the films are joined to each other by tape B' across seam joint B. Tape B' itself is not thermally sealable. If an attempt is made to thermally seal table B', then the tape will be melted, causing problems.

JP11-236002A discloses a packaging apparatus which does not thermally seal seam joint B between tapes. The disclosed packaging apparatus will be briefly described below with reference to FIG. 2.

As shown in FIG. 2, the packaging apparatus disclosed in JP11-236002A is of a general structure which comprises folding guide 114 for folding a film into two plies, vertical sealing mechanism 130 for forming vertical seal F1 on the folded sheet, feeding nozzle 15 for feeding a content into the film, horizontal sealing mechanism 150 for forming horizontal seals F2 on the folded sheet at portions which will serve as bottom and top regions of a package bag, and cutting mechanism 160 for cutting horizontal seals F2 to sever the package bag from the film. These mechanisms are actuated at given timings in timed relation to the feeding of the film to successively manufacture package bags filled with the content.

The packaging apparatus is mainly characterized in that it further includes seam joint detecting means 16 for detecting seam joints B, and the actuation of the above mechanisms is controlled based on the detected result from seam joint detecting means 16 to prevent tapes B' at seam joints B from being thermally sealed. Therefore, the problems (e.g., a portion of the melted tape is applied to a seal bar of the horizontal sealing mechanism which results in lowering the quality of package bags which will subsequently be manufactured) caused by the melted tape are prevented from arising.

Another known packaging apparatus of this type includes a mechanism for joining the terminal end of a film from a film roll and the beginning end of the next film roll to each other at the time that the first-mentioned film roll is finished up (see JP09-58616A). The joining mechanism allows the packaging apparatus to continuously manufacture package bags without the need for a tedious process for setting a next film roll in place again each time one film roll is used up.

DISCLOSURE OF THE INVENTION

Problems to be Solved by the Invention

When the terminal end of a film and the beginning end of the next film are joined to each other, the two films are in a state shown in FIG. 3A. Specifically, as shown in FIG. 3A, film 1A and next film 1B overlap each other across joint 5 and are joined to each other by seal 3. The resultant elongate film thus joined is folded in a subsequent process as shown in FIG. 3B. Then, the film has its side edges (shown hatched) longitudinally sealed by a longitudinal sealing mechanism, so that the film is of a tubular form (referred to as "tubular film").

The joined elongate film is thermally sealed by horizontal sealing mechanism 150. When horizontal sealing mechanism 150 horizontally seals joint 5 of the films, it tends to cause the following problems: Since the films overlap each other as two plies in joint 5, the heat is less liable to be transferred to these films than when the other portions of the films are horizontally sealed, possibly causing a sealing failure in the horizontally sealed region. The sealing failure may possibly allow the packaged content to leak out. This problem is also not desirable as it presents an obstacle to the continuous production of package bags, leading to a reduction in production efficiency. The problem also occurs in vertically sealed regions.

One solution to the above problems is to use a sensor or the like for detecting joint 5 and to prevent joint 5 from being thermally sealed as indicated by the manufacturing method disclosed in JP11-236002A. However, the method disclosed in JP11-236002A is only concerned with the detection of seam joints B (see FIG. 1) on one film roll. Seam joints B can be relatively easily detected because tapes B' are applied to seam joints B. However, as no tape is applied to joint 5 (FIG. 3) of the films, it is relatively difficult to detect joint 5. In particular, if films 1A, 1B are transparent, then joint 5 (including seal 3) is also transparent, making it difficult for an optical sensor to detect joint 5.

The present invention has been made in view of the above difficulties. It is an object of the present invention to provide a packaging apparatus including a mechanism for joining a film from a film roll and a film from another film roll, the packaging apparatus being capable of preventing a joint of the films from suffering a thermal sealing failure, thereby increasing production efficiency.

Means for Solving the Problems

To achieve the above object, there is provided in accordance with the present invention a packaging apparatus comprising film supply means for joining the terminal end of a first film reeled out from a first film roll and the beginning end of a second film reeled out from a second film roll to each other, and supplying the first and second films which are joined to each other as an elongate film, and packaging means for shaping the elongate film into a tubular form, vertically sealing the tubular form into a tubular film with a vertical sealing mechanism, horizontally sealing the tubular film with a horizontal sealing mechanism to produce a bottom of the tubular film, feeding a content into the tubular film, and thereafter horizontally sealing the bottomed tubular film again to produce a package bag filled with the content, wherein the packaging apparatus further comprises distance adjusting means for changing the distance along the elongate film from a position, in which the first film and the second film are joined to each other to a position in which the tubular film is horizontally sealed, depending on the length of the package bag to be manufactured, to a length which is not integral multiple of the length.

The packaging apparatus includes the distance adjusting means for changing the distance along the film from the position in which the films are joined to each other to the position in which the tubular film is horizontally sealed, depending on the size (length) of the package bag. Therefore, after the distance from the joined position to the horizontally sealed position is changed by the distance adjusting means, even if the films are joined and the joint between the films is delivered to the packaging means, the horizontal sealing mechanism does not sandwich the joint. This is because the distance from the joined position to the horizontally sealed position is not an integral multiple of the length of the package bag. Since the joint is not placed in the horizontally sealed position simply by changing, in advance, the distance between the joined position and the horizontally sealed position, the packaging apparatus does not need a sensor or the like for detecting the joint.

In the above invention, the distance adjusting means may comprise a film accumulator disposed between the film supply means and the packaging means, for guiding and holding the elongate film in a meandering fashion with a plurality of guide rollers, and the guide rollers may include movable guide rollers for changing the length of the elongate film held in the film accumulator. Specifically, the guide rollers include fixed guide rollers and the movable guide rollers which are movable toward and away from the fixed guide rollers, and the movable guide rollers automatically move to a preset position depending on the length of the package bag to be manufactured.

When the vertical sealing mechanism operates, it should preferably vertically seal a region of the elongate film including the joint for a period of time which is longer than a normal vertically sealing time. The joint is thus vertically sealed sufficiently well so as to prevent the content from leaking out of the vertically sealed region. The region including the joint should preferably be vertically sealed at a timing that is after a preset number of cycles after the film supply means has joined the first film and the second film to each other. As the timing for vertically sealing the region is not generated by detecting the joint, there is no need for a sensor or the like for detecting the joint.

The packaging means may continuously manufacture the package bag while the vertical sealing mechanism and the horizontal sealing mechanism are feeding the tubular film through a box motion process. The movable guide rollers should preferably move at a constant speed toward the fixed guide rollers while the film supply means is joining the first film and the second film to each other. The packaging means can thus continuously manufacture the package bag without stopping its packaging operation.

The term "box motion" refers to a process of operating a thermally sealing mechanism (the vertical sealing mechanism or the horizontal sealing mechanism) of the packaging means to move a sealing bar of the thermally sealing mechanism in synchronism with the feeding of the film while heating the film, so that a thermally sealed region (a vertically sealing region or a horizontally sealed region) can be formed in the film without the need to stop feeding the film. The sealing bar moves to a given position along the direction in which the film is fed, thereafter is retracted from the film, and then moves back to its initial position along a direction opposite to the direction in which the film is fed.

ADVANTAGES OF THE INVENTION

With the packaging apparatus according to the present invention, as described above, since the joint between the films is not placed in the horizontally sealed position, the horizontally sealed region is prevented from suffering a sealing failure, and the content is prevented from leaking out of the horizontally sealed region during the packaging operation. Consequently, the packaging apparatus can continuously manufacture package bags without any need to stop, and can have an increased production efficiency.

The above and other objects, features, and advantages of the present invention will become apparent from the following description with reference to the accompanying drawings which illustrate an example of the present invention.

BRIEF DESCRIPTION OF THE DRAWINGS

FIG. 11A shows the distance before it is adjusted and FIG. 11B shows the distance after it is adjusted.

DESCRIPTION OF REFERENCE CHARACTERS

Figure 1A:
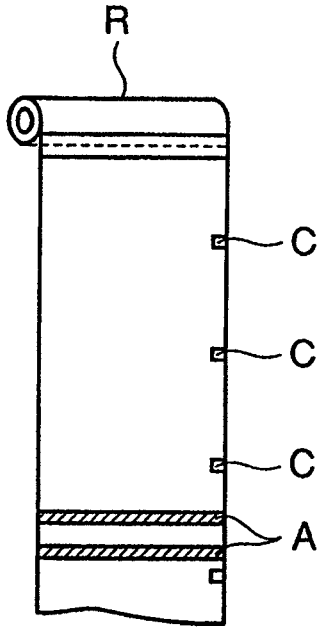
FIG. 1A is a view showing a film reeled out from a film roll.

1A, 1B film
1' tubular film
2 unfilled space

3 sealed portion
5 joint
10 packaging apparatus
10A film supply mechanism
10B film accumulator
10C packaging mechanism
14 folding guide
15 feeding nozzle
16 stepping roller
17 rotary encoder
18 rod-shaped member
18*a* guide roller
21 accumulating roller
22 roller
30 horizontal sealing mechanism
31 heater bar
24 roller holding member
41 feed roller
45 squeezing roller
60 horizontal sealing mechanism
61 heater bar
62 heater bar bearing member
71 joining sealer
76, 77 roll holding member
81 cutter
83 sensor
85 rollers for reeling out films
91, 92 package bag
F1 vertically sealed region
F2 horizontally sealed region
Ra, Rb Raw film roll

BEST MODE FOR CARRYING OUT THE INVENTION

Figure 4:
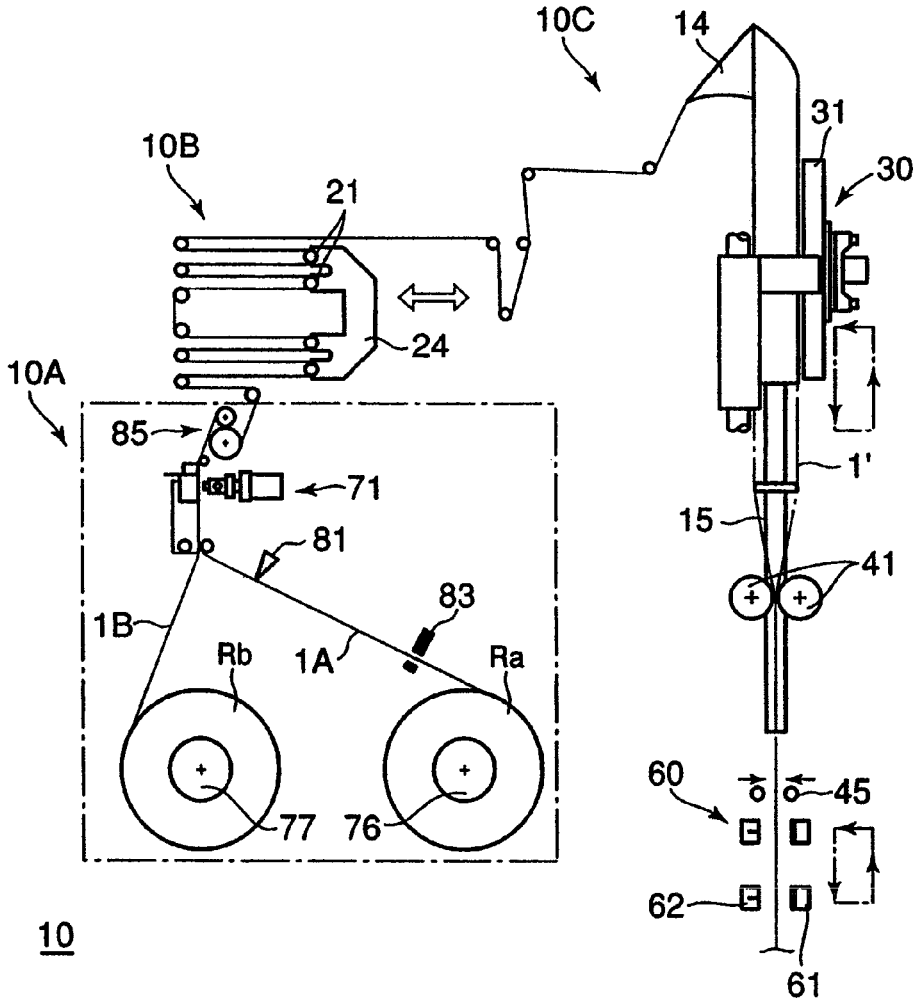
FIG. 4 is a schematic view showing an arrangement of a packaging apparatus according to an exemplary embodiment of the present invention.
Figure 5A:
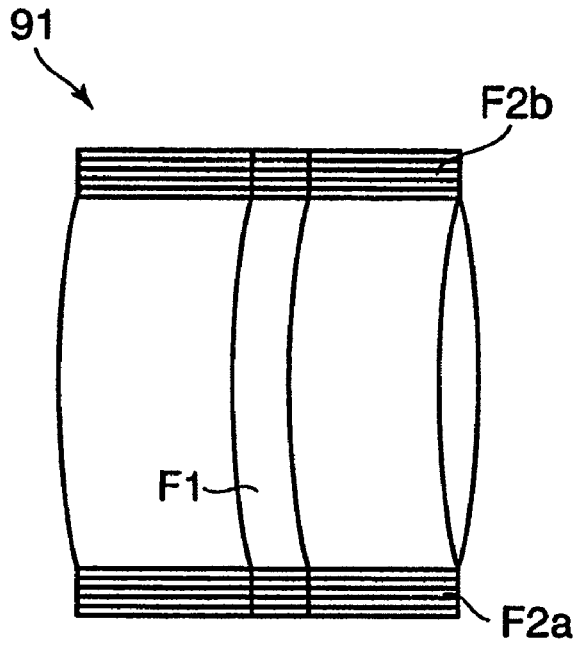
FIG. 5A is a view showing a package bag manufactured by the packaging apparatus shown in FIG. 4.

Exemplary embodiments of the present invention will be described below with reference to the drawings. FIG. 4 is a schematic view showing an arrangement of a packaging apparatus according to an exemplary embodiment of the present invention. FIG. 5A is a view showing a package bag manufactured by the packaging apparatus shown in FIG. 4.

As shown in FIG. 4, packaging apparatus 10 according to the present exemplary embodiment generally comprises film supply mechanism 10A for reeling out films from film rollers Ra, Rb and joining film 1A and film 1B to each other when required, packaging mechanism 10C for forming vertically sealed regions and horizontally sealed regions in the films to continuously manufacture package bags, and film accumulator 10B positioned between film supply mechanism 10A and packaging mechanism 10C for guiding and holding the film in a meandering fashion.

Figure 5B:
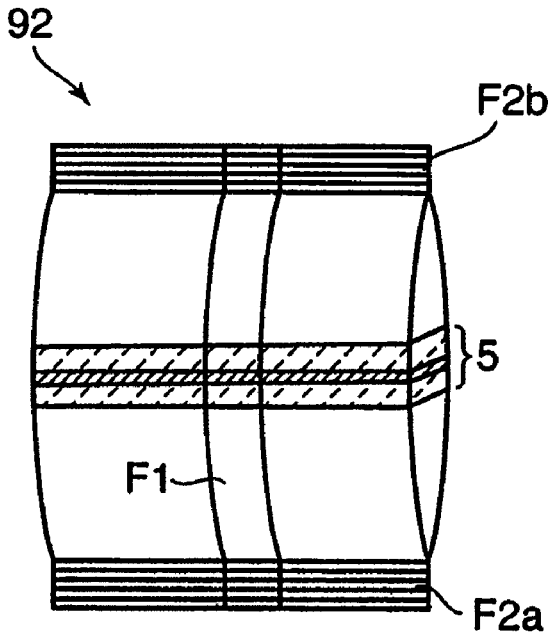
FIG. 5B is a view showing a package bag in a different shape manufactured by the packaging apparatus shown in FIG. 4.

As shown in FIG. 5A, package bag 91 manufactured by packaging apparatus 10 is a so-called pillow-type package bag having two horizontally sealed regions F2*a*, F2*b* (also collectively represented by "F2") and vertically sealed region F1 serving as a back lining. Package bag 91 is filled with content such as a liquid, a viscous substance, or the like. Package bag 92 shown in FIG. 5B includes joint 5, between films, which is positioned in a belly portion thereof.

If the content which fills the package bag is a liquid and if either sealed region F1 or F2 or joint 5 has a sealing failure, then the content may possibly leak from the region in which the sealing failure occurs. Therefore, the package bag of this type needs to have its sealed regions thermally sealed reliably. In particular, package bag 92 shown in FIG. 5B has two overlapping films in joint 5 and tends to cause a sealing failure in vertically sealed region F1. These problems will be described in specific detail below with reference to FIG. 6.

Figure 6A:
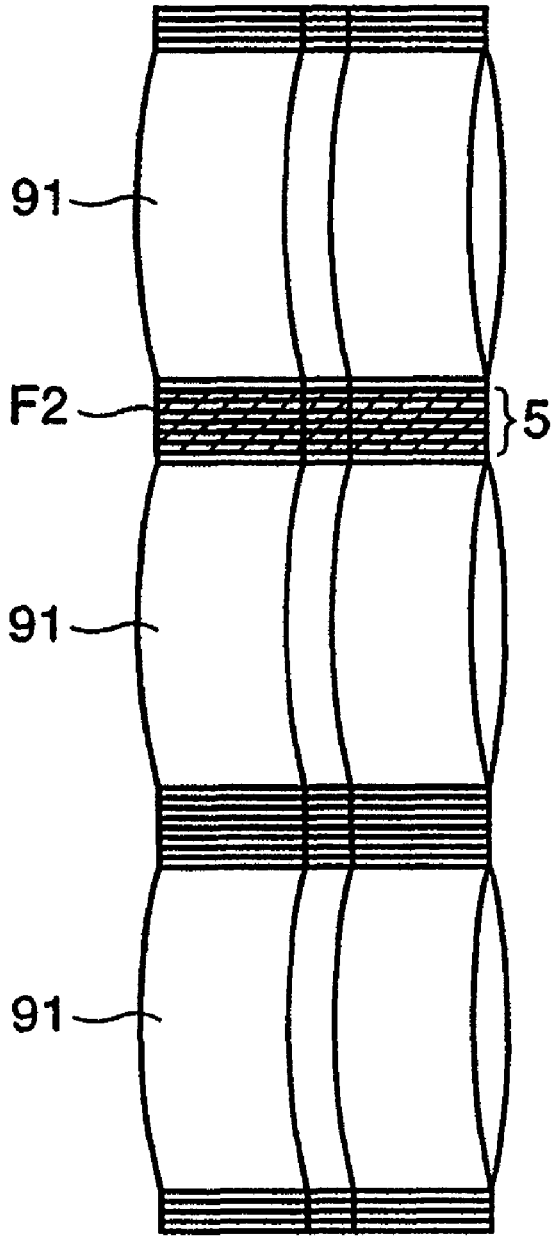
FIG. 6A is a view showing a succession of package bags shown in FIG. 5.
Figure 6B:
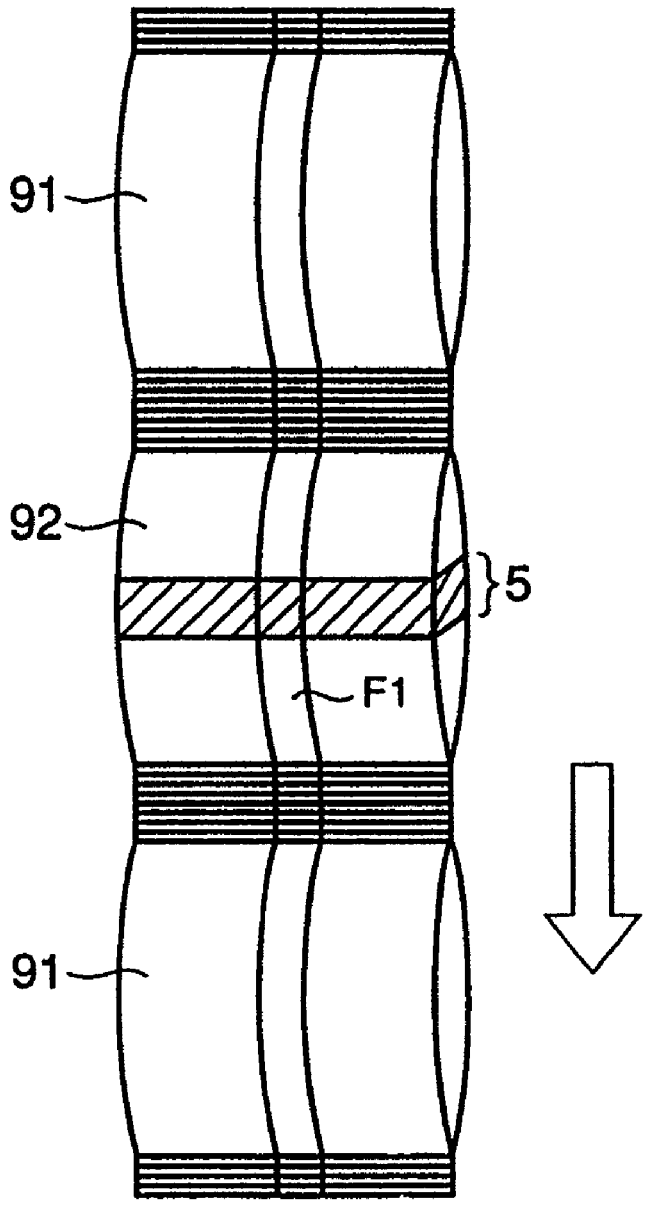
FIG. 6B is a view showing a succession of package bags shown in FIG. 5, with one of the package bags including a joint.

Sealing failure problems in joint 5 are classified into those caused when joint 5 is positioned in horizontally sealed region F2 as shown in FIG. 6A and those caused when joint 5 is positioned in the belly portion of the package bag as shown in FIG. 6B. In FIG. 6A, a sealing failure occurs in horizontally sealed region F2, tending to allow the content to leak therefrom. Since horizontally sealed regions F2 of both upper and lower package bags suffer a sealing failure, two package bags 91 become defective.

In FIG. 6B, vertically sealed region F1 suffers a sealing failure, tending to allow the content to leak therefrom. However, only one package bag becomes defective. If package bag 92 is not filled with content, then no content leakage is caused even though vertically sealed region F1 suffers a sealing failure. No problem arises if lower package bag 91 is dangling from package bag 92 as shown. However, if lower package bag 91 has already been severed from package bag 92, then the feed of package bags is likely to suffer trouble for the following reasons:

If lower package bag 91 has already been severed from package bag 92 and empty package bag 92 is dangling from the lowest end of the tubular film, then since package bag 92 is empty, the tubular film is free from tensile forces applied by the weight of the content. Consequently, empty package bag 92 tends to contact heater bar 61 (see FIG. 4), for example, whereupon the feed of package bags experiences problems.

The above problems are summarized as follows: For making package bags according to the present exemplary embodiment, firstly, it is preferable not to position joint 5 between films in horizontally sealed region F2 from the standpoint of sealing failures and also from the standpoint of reducing wasted package bags. Secondly, even if joint 5 is positioned in the belly portion of the package bag as shown in FIG. 6B, it is preferable to prevent the content from leaking from vertically sealed region F1.

As will be described in detail later, packaging apparatus 10 according to the present exemplary embodiment deals with the first point referred to above to solve these problems by moving roller holding member 24 (see FIG. 4) of film accumulator 10B to change the length of the film feed path. Furthermore, packaging apparatus 10 deals with the second point referred to above to solve these problems by adjusting the operating time of vertical sealing mechanism 30.

Figure 1B:
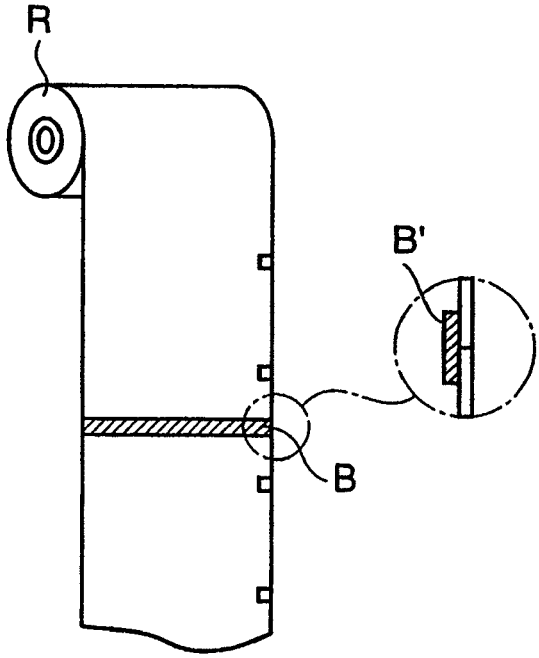
FIG. 1B is a view showing a tape applied to a seam joint between films.
Figure 2:
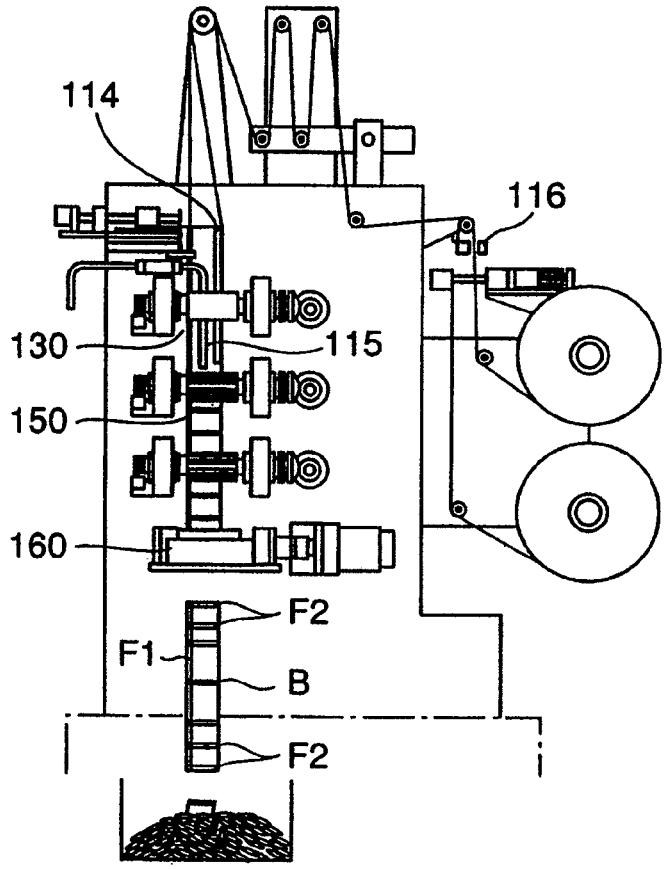
FIG. 2 is a view showing an example of a packaging apparatus according to the background art.

Film joining mechanism 10A shown in FIG. 4 may be of a general nature for use in a packaging apparatus of this type. According to the present exemplary embodiment, film joining mechanism 10A comprises two roll holding members 76, 77 on which respective film rolls Ra, Rb are removably mounted, joining sealer 71 for joining the terminal end of film 1A to the beginning end of film 1B following film 1A, and rollers 85 for reeling out the films from the film rolls. Film joining mechanism 10A also has sensor 83 for detecting end marks A (see FIG. 1) of the film rolls and cutter 81 for cutting off the film.

An example of the operation of film joining mechanism 10A will be described below. The state of film joining mechanism 10A shown in FIG. 4 is regarded as an initial state. In FIG. 4, one film 1A is reeled out to packaging mechanism 10C and other film 1B is in a standby state with its leading end held and fixed near joining sealer 71. In this stage, films 1A, 1B are not yet joined to each other.

Figure 3A:
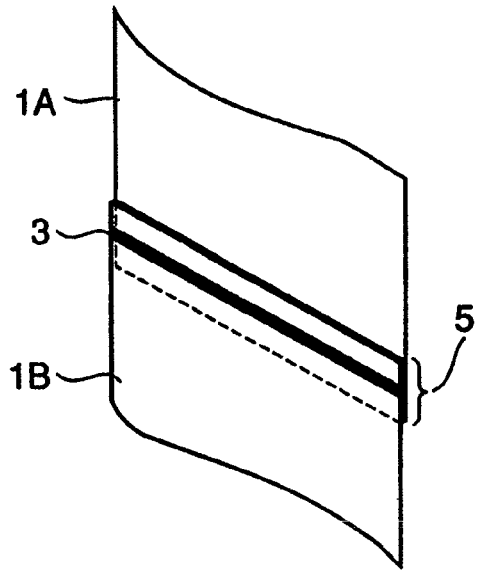
FIG. 3A is a view of a structure around a joint between films, showing the films prior to being folded.
Figure 3B:
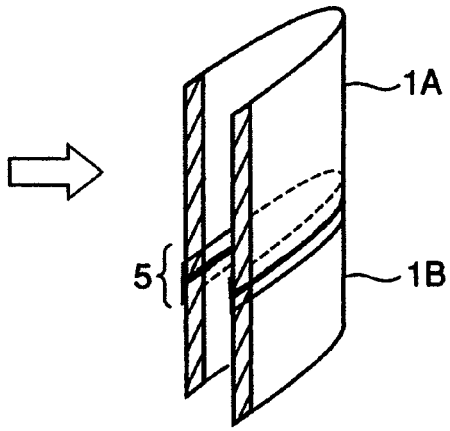
FIG. 3B is a view of a structure around a joint between films, showing films that have been folded.

In a normal mode of operation (when sufficient remaining film lengths are available), joining sealer 71 is in a retracted position, and rollers 85 for reeling out films are actuated to continuously reel out film 1A from film roll Ra. Thereafter, when film 1A is consumed and its end marks A are detected by sensor 83, joining sealer 71 is advanced to thermally seal film 1A and film 1B to each other, thereby joining the two films. Subsequently, cutter 81 is actuated to cut off the superfluous film length. In a subsequent process, film 1B from film roll Rb will be used. The joint where the two films are joined to each other includes two plies overlapping each other, as shown in FIG. 3.

Packaging mechanism 10C comprises folding guide 14 for folding the film into a tubular form, vertical sealing mechanism 30 for vertically sealing side edges of the film folded by folding guide 14 to form vertically sealed region F1 thereby producing tubular film 1', and a pair of feed rollers 45, a pair of squeezing rollers 45, and horizontal sealing mechanism 60 which are disposed downstream of vertical sealing mechanism 30 with respect to the direction in which the film is fed.

Packaging mechanism 10B is of a structure identical to a vertical filling packaging machine disclosed in JP-A 2004-276930 filed earlier by the present applicant. Each of vertical sealing mechanism 30 and horizontal sealing mechanism 60 performs a thermally sealing process called "box motion" for manufacturing package bags while continuously feeding the film without stopping it.

Vertical sealing mechanism 30 includes heater bar 31 with a built-in heating means such as a heater or the like. Heater bar 31 is movable toward and away from the film, and is also reciprocally movable vertically (in the direction in which the film is fed).

Tubular film 1' is fed in a substantially circular cross-sectional shape, or stated otherwise, with a space kept therein, until it passes through vertical sealing mechanism 30. Thereafter, tubular film 1' is pressed to a flat shape by a guide plate (not shown) disposed between vertical sealing mechanism 30 and feed rollers 41.

Feed rollers 41 are disposed in sandwiching relation to the transverse ends of pressed tubular film 1'. Feed rollers 41 serves as film feed means in packaging mechanism 10B, and rotate to feed tubular film 1' downwardly.

The pair of squeezing roller 45 grips the tubular film in a manner to divide the content which is fed into the tubular film from feeding nozzle 15. While thus gripping the tubular film, the pair of squeezing roller 45 rotates to feed the tubular film downwardly with an unfilled space free of the content being formed in the tubular film.

Horizontal sealing mechanism 60 comprises heater bar 61 with a built-in heating means such as a heater or the like, and heater bar bearing member 62 disposed in confronting relation to heater bar 61. These paired members sandwich tubular film 1' and heat the film to form horizontal sealing regions F2 (see FIG. 5) in the film. Heater bar 61 and heater bar bearing member 62 also make box motion the same as vertical sealing mechanism 30. In other words, heater bar 61 and heater bar bearing member 62 move downwardly in synchronism with the feeding of the film while sandwiching tubular film 1'.

Although not shown, heater bar 61 has a built-in cutter for cutting horizontal sealing regions F2 to sever the package bag from tubular film 1'. Heater bar bearing member 62 has a corresponding clearance groove for preventing the cutter as it projects from interfering with heater bar bearing member 62.

Figure 7:
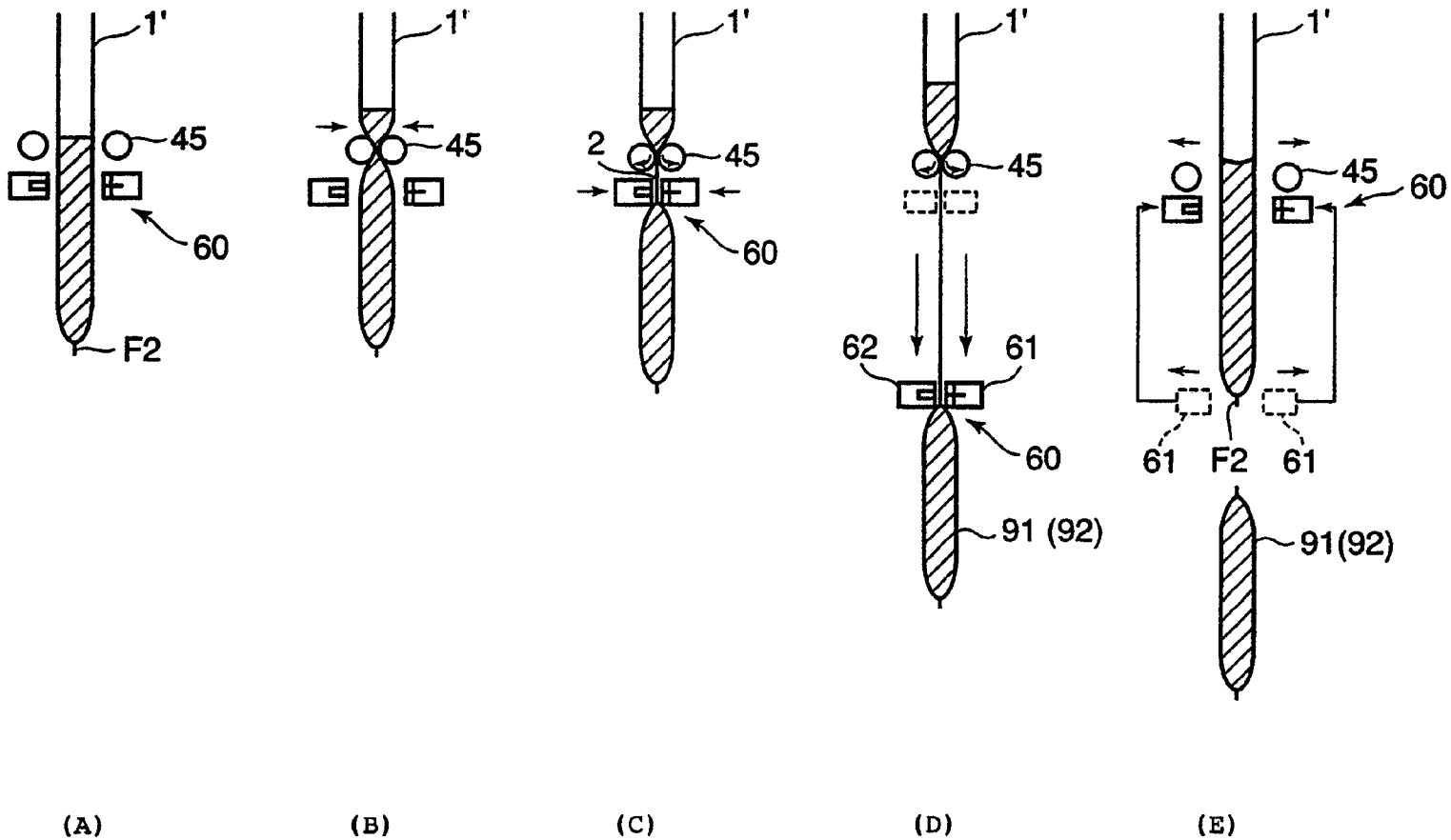
FIGS. 7A through 7E are views showing an example of a process of manufacturing package bags.

A packaging process of packaging mechanism 10C thus constructed will be briefly described below with reference to FIG. 7.

In FIG. 7A, horizontally sealed region F2 formed in a previous packaging process is disposed at the lower end of tubular film 1', so that tubular film 1' is bottomed. Tubular film 1' is filled with content whose liquid level is positioned just beyond squeezing rollers 45.

Then, as shown in FIG. 7B, the pair of squeezing rollers 45 grips the portion of tubular film 1' in which the content is present, thereby dividing the content into upper and lower content.

Then, as shown in FIG. 7C, squeezing rollers 45 are rotated to deliver tubular film 1' downwardly with content-free unfilled space 2 formed therein. After the tubular film is delivered to a position in which unfilled space 2 is sandwiched by horizontal sealing mechanism 60, horizontal sealing mechanism 60 sandwiches unfilled space 2.

Thereafter, as shown in FIG. 7D, while heater bar 61 and heater bar bearing member 62 are sandwiching unfilled space 2, squeezing rollers 45 are continuously rotated, and horizontal sealing mechanism 60 is moved downwardly in synchronism with the feeding of the film. While tubular film 1' is being sandwiched by heater bar 61 and heater bar bearing member 62, tubular film 1' is heated to form horizontally sealed region F2. After heater bar 61 and heater bar bearing member 62 move to the lowermost end, the built-in cutter of heater bar 61 is projected to sever the package bag.

Then, as shown in FIG. 7E, the tubular film is released from heater bar 61 and heater bar bearing member 62 and also from the pair of squeezing rollers 45. Now, one package bag 91 (92) filled with the content is obtained. In tubular film 1', the content that has been stored above squeezing rollers 45 falls downwardly to feed tubular film 1'. Thereafter, heater bar 61 and heater bar bearing member 62 move to their original positions, bringing joining mechanism 10A back to the initial state shown in FIG. 7A.

Packaging mechanism 10C repeats the above packaging operation to continuously manufacture package bags. In packaging mechanism 10C, the stroke of vertical movement of horizontal sealing mechanism 60 is variable to make it possible to manufacture package bags of different sizes.

Such package bags of different sizes can be manufactured under the control of a controller, not shown. Specifically, the controller has some recorded operation patterns depending on the sizes (lengths) of package bags to be produced, and operates the packaging mechanism according to one of the operation patterns depending on the size of package bags that is entered from a control panel or the like.

Film accumulator 10B will be described below with reference to FIG. 8.

Figure 8:
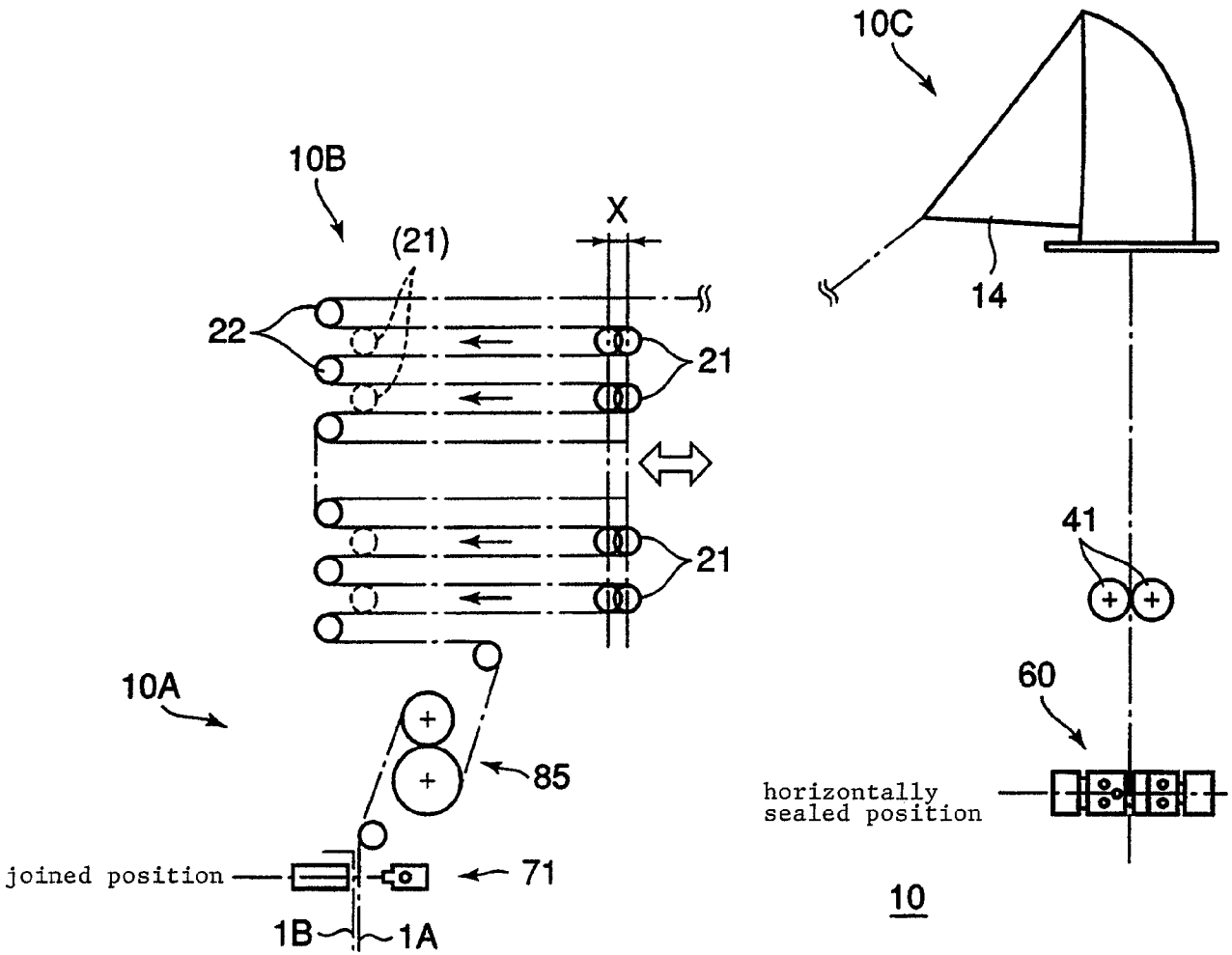
FIG. 8 is a schematic view illustrative of an arrangement of a film accumulator.

As shown in FIG. 8, film accumulator 10B comprises a plurality of guide rollers including fixed rollers 22 and movable accumulating rollers 21. The film reeled out from film supply mechanism 10A is horizontally trained around and extends between the guide rollers. Though the film may be vertically trained around and extend between the guide rollers, it is easier to set the film on the guide rollers if the film is horizontally trained around and extends between the guide rollers.

In packaging apparatus 10 according to the present exemplary embodiment, packaging mechanism 10C produces package bags in the box motion mode. In the box motion mode, the film is drawn in continuously rather than intermittently. When film supply mechanism 10A joins the films, since joining sealer 71 needs to sandwich and thermally seal two films 1A, 1B, the films stop being reeled out while the films are being thermally sealed. In other words, whereas packaging mechanism 10C consumes the film continuously, the film from film supply mechanism 10A temporarily stops being supplied.

Film accumulator 10B has a basic function to make it possible for packaging mechanism 10C to continue its packaging operation under the circumstances. To perform the basic function, accumulating rollers 21 move from their initial position indicated by the solid lines in FIG. 8 at a constant speed toward rollers 22 until accumulating rollers 21 reach the dotted-line position. Specifically, roller holing member 24 (see FIG. 4), by which all accumulating rollers 21 are held, moves horizontally at a constant speed to move accumulating rollers 21 at a constant speed.

Figure 9:
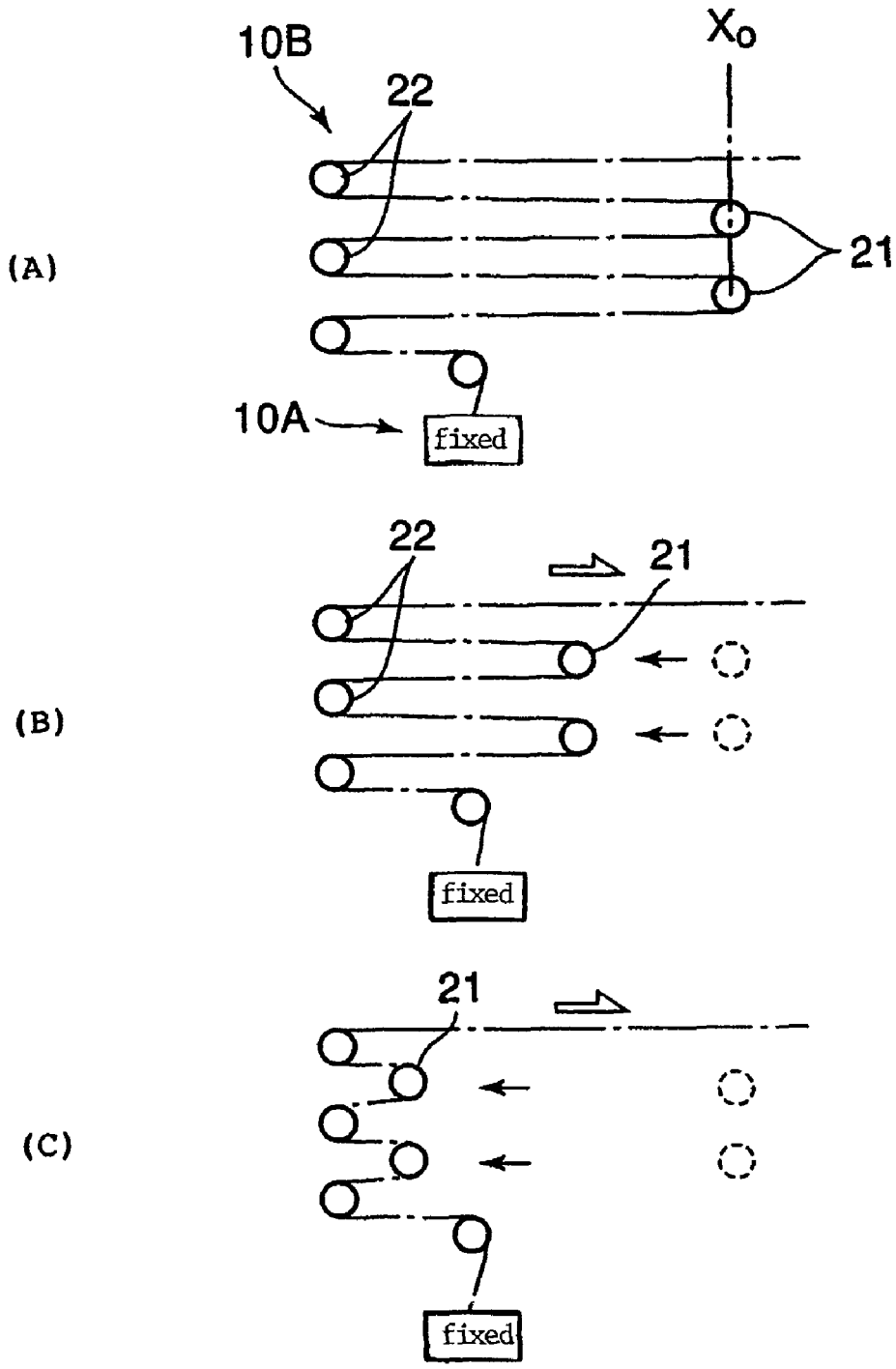
FIGS. 9A through 9C are views illustrative of the operation of the film accumulator.

The operation of film accumulator 10B will be described below with reference to FIG. 9.

FIG. 9A shows a state of film accumulator 10B immediately after film supply mechanism 10A has started to join the films while film packaging mechanism 10C is continuously performing its packaging operation. Accumulating rollers 21 are positioned in initial position $X_0$. In this state, rollers 85 for reeling out films (see FIG. 8) stop operating.

Then, as shown in FIG. 9B, in synchronism with the film drawn toward packaging mechanism 10C as it operates, accumulating rollers 21 move at a constant speed toward rollers 22 until finally they reach the position shown in FIG. 9C. As accumulating rollers 21 thus move, the amount of film held in film accumulator 10B is reduced, and the corresponding film is supplied to packaging mechanism 10C. Accordingly, even while film supply mechanism 10A is joining the films, packaging mechanism 10C is supplied with the film. Therefore, even during the time in which film supply mechanism 10A is joining the films, packaging mechanism 10C can continue its packaging operation.

When accumulating rollers 21 move to the position shown in FIG. 9C and the joining process of film supply mechanism 10A is finished, rollers 85 for reeling out films are actuated again. Film accumulator 10B operates in a fashion which is the reverse of the above operation, moving accumulating rollers 21 at a constant speed to initial position $X_0$. Film accumulator 10B then again accumulates a predetermined amount of film. In this operation, the speed at which the film is reeled out is represented by the sum of the speed at which the film is fed by packaging mechanism 10C and the increase per unit time of the film accumulated in film accumulator 10B. Therefore, rollers 85 for reeling out films need to be actuated at a speed corresponding to that speed.

Figure 10:
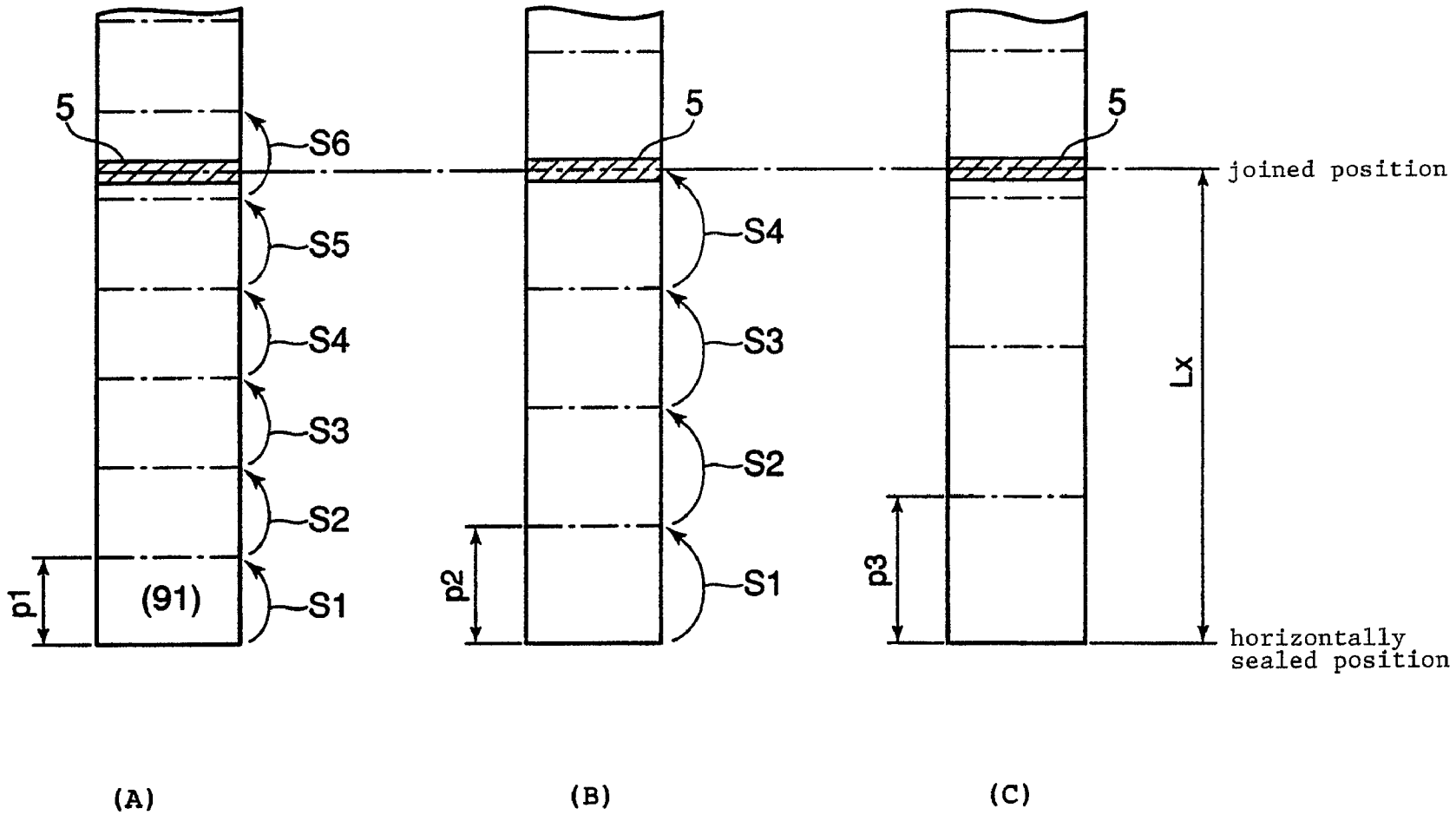
FIGS. 10A through 10C are schematic views showing the relationship between joints and horizontally sealed positions in case the sizes of package bags to be manufactured are different from each other.
Figure 11:
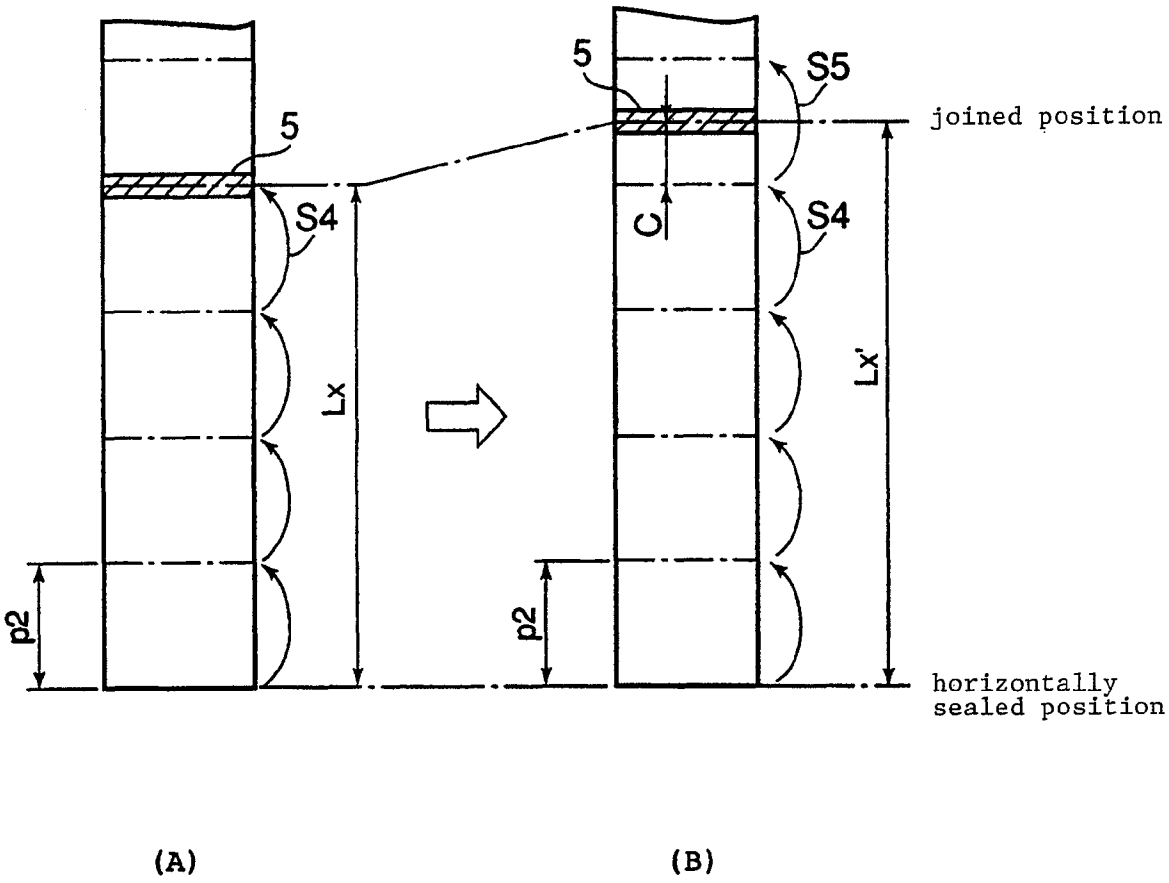
FIG. 11 is a schematic view illustrative of the manner in which the distance between a joint position and a horizontally sealed position is changed.

A process of preventing joint 5 between the films from being positioned in horizontal sealing mechanism 60 will be described below with reference to FIGS. 10, 11. FIG. 10 is a schematic view showing the relation between joints 5 and horizontally sealed positions in the case where the sizes of package bags to be manufactured are different from each other.

FIG. 10A shows an example in which package bags having a length of p1 (e.g., 300 mm) are manufactured. FIG. 10B shows an example in which package bags having a length of p2 (e.g., 400 mm) are manufactured. FIG. 10C shows an example in which package bags having a length of p3 (e.g., 500 mm) are manufactured. A "joined position" refers to a position in which the films are joined to each other by film supply mechanism 10A, and a "horizontally sealed position" refers to a position in which the films are horizontally sealed by horizontal sealing mechanism 60, or specifically heater bar 61 and heater bar bearing member 62 sandwich the film.

As shown in FIG. 10A, if the package bags to be manufactured have a length of p1, when the horizontally sealing process is performed at s1, s2, . . . , s5, s6, horizontal sealing mechanism 60 does not horizontally seal joint 5. This holds true if the package bags have a length of p3 as shown in FIG. 10C.

As shown in FIG. 10B, if the package bags have a length of p2, then as the horizontally sealing process is performed at s1, s2, . . . , joint 5 is formed in a horizontally sealed position when the horizontally sealing process is performed at s4 (when the fourth horizontally sealing process is performed), and the horizontal sealing mechanism horizontally seals joint 5. This is because distance Lx (film length) between the "horizontally sealed position" and the "joined position" is an integral multiple of length p2 of the package bags to be manufactured.

According to the present exemplary embodiment, distance Lx between the horizontally sealed position and the joined position is changed depending on the length of the package bags to be manufactured for thereby preventing joint 5 between the films from lying in the horizontally sealed position. Specifically, in FIG. 11B, since joint 5 lies in the horizontally sealed position when the horizontally sealing process is performed at s4, distance Lx may be increased to distance Lx' as shown in FIG. 11B. Alternatively, distance Lx may be reduced to achieve the same operation.

The above changed distance is expressed by the following equation:

$$\text{(changed distance) } Lx' = p \times n + c$$

where p is the length of package bags, n is an integer (corresponding to the number of package bags) and c is a given length (smaller than p).

When distance Lx is changed to length Lx' that is not an integral multiple of the length of package bags, joint 5 is preventing from lying in the horizontally sealed position.

According to the present exemplary embodiment, distance Lx is changed as follows: The initial position of accumulating rollers 21 is changed by distance Lx depending on the size of package bags to be manufactured. When the initial position of accumulating rollers 21 is changed, the length of the film accumulated in film accumulator 10B is also changed, resulting in a change in distance Lx.

The initial position of accumulating rollers 21 should preferably be changed automatically at the time the size of package bags to be manufactured is input. Specifically, the controller stores in advance initial positions of accumulating rollers 21 which are set depending on the sizes of package bags, and when the size of package bags to be manufactured is input, the controller moves accumulating rollers 21 to the given initial position that has been set.

The "given initial position" should preferably be set so as to position joint 5 centrally on the package bag. With the "given initial position" thus set, the possibility that joint 5 will lie in the horizontally sealed region is reduced even if the film is fed at a slightly different rate. The same principle is also applicable to the package bags shown in FIGS. 10A, 10B. Specifically, since joint 5 is not positioned in the horizontally sealed region in FIGS. 10A, 10B, no problem arises. Preferably, however, the initial position of accumulating rollers 21 may be changed to position joint 5 centrally on the package bag thereby to reduce the possibility that joint 5 will be positioned in the horizontally sealed region. Conditions for positioning joint 5 centrally on the package bag may be that c=p/2 in the above equation and a length which is one half of length p of package bags is added to distance Lx shown in FIG. 11.

A process for preventing the content from leaking out of the vertically sealed region at the time joint 5 is positioned centrally on the package bag will be described below.

In packaging apparatus 10 according to the present exemplary embodiment, vertical sealing mechanism 30 vertically seals a region including joint 5 for a longer period of time (e.g., 4 seconds) than the normal vertically sealing operation (e.g., 1 second).

In this manner, since sufficient heat is applied to vertically sealed region L1 corresponding to joint 5 where four plies of the film overlap each other, the film plies are thermally sealed well. As a result, the content is prevented from leaking out of vertically sealed region F1.

As packaging apparatus 10 according to the present exemplary embodiment does not have a sensor or the like for detecting joint 5, it is important to determine a timing to perform the vertically sealing process. For example, cycles may be counted from the time when the joining of the films is finished and a vertically sealing process may be performed at the timing when a preset count is reached.

Specifically, since the distance from the joining position to the vertically sealing position is predetermined, the number of cycles prior to a vertically sealing process for vertically sealing joint 5 can be calculated based on the distance. Accordingly, the vertically sealing process may be carried out at the timing after the number of cycles has been calculated, and there is no need for a sensor to detect joint 5.

If the vertically sealing process is to be performed for a longer period of time than usual, then the box motion process may be slowed down temporarily to ensure that heater bar 31 stays in contact with the films for a longer period of time. Alternatively, the feeding of the films may be stopped temporarily and the vertically sealing process may be performed.

In packaging apparatus 10 according to the present exemplary embodiment, as described above, since distance Lx between the horizontally sealed position and the joined position is changed to given distance Lx' depending on the size of package bags to be manufactured, the horizontal sealing mechanism does not horizontally seal joint 5. Therefore, there is no leakage of the content due to a sealing failure of the horizontally sealed region, and production efficiency is not lowered.

When a packaging apparatus of this type starts to operate again after it has temporarily stopped operating, the sealing bars of the sealing mechanisms may be reheated or a pump serving as the drive source of feeding nozzle 15 may be restarted. The sealing mechanisms and the pump tend to be relatively unstable in operation when they start to move, and take a while to become stabilized in operation. In order to eliminate such a waste of time, it is preferable to be able to continue the packaging process continuously without shutdown as is the packaging apparatus according to the present exemplary embodiment.

If joint 5 is not positioned on the horizontally sealed region, then only one package bag is produced as a defective package bag. Therefore, such positioning of joint 5 is advantageous from the standpoint of reducing wasted package bags. In packaging apparatus 10 according to the present exemplary embodiment, joint 5 is not positioned on the horizontally sealed region simply by changing distance Lx in advance, and it is not necessary to detect the joint by using an optical sensor or the like. Consequently, the above operation can be carried out without any problems even if transparent films are employed. As described above, if the films are transparent, then joint 5 is also transparent and it is difficult to detect the joint by using an optical sensor or the like. The structure according to the present exemplary embodiment does not need to take such a problem into account. This, however, does not mean that a sensor for detecting joint 5 cannot be used in the present invention.

In packaging apparatus 10 according to the present exemplary embodiment, since a region including joint 5 is vertically sealed for a longer period of time than usual, vertical sealed region F1 is well formed even if joint 5 between films is positioned centrally on the package bag. Therefore, the content will not leak out, and production efficiency will not be lowered.

Vertically sealed regions F1 of package bags are not limited to any form, but may be of a butt seam or a lap seam. Package bags are not limited to pillow-type package bags, but may be three-way sealed-type package bags or four-way sealed-type package bags.

The changing of the initial position of accumulating rollers 21 has been described above with reference to FIG. 8, etc. For actually setting distance X for which accumulating rollers 21 are to be moved, the following elements need to be taken into account: There is a need for taking into account a change in the length of the path of the film due to the changing of folding guide 14. Since folding guide 14 is normally changed depending on the size of package bags to be manufactured, distance X for which accumulating rollers 21 are to be moved may be set in a manner to compensate for the change due to the changing of folding guide 14.

Figure 12:
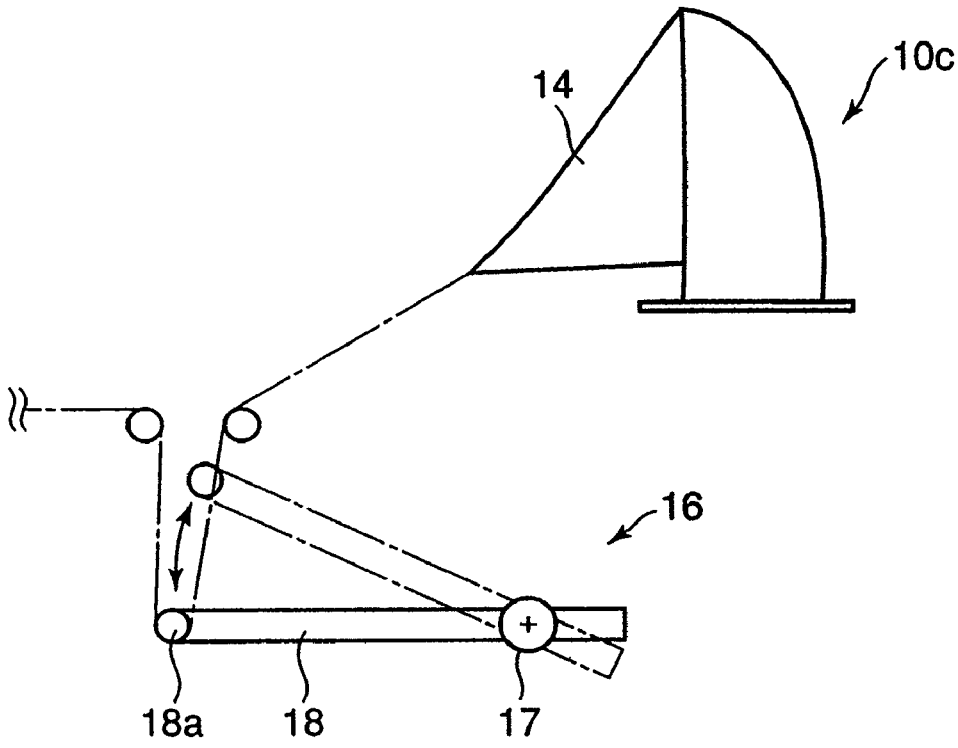
FIG. 12 is a view illustrative of an additional component that can be used by the packaging apparatus according to the present invention.

Packaging apparatus 10 may include, in addition to the above components, a mechanism for applying a given tensile force to the film to prevent the film from sagging. One example of such a mechanism comprises stepping roller 16 shown in FIG. 12. Stepping roller 16 comprises rod-shaped member 18 having one end pivotally supported and guide roller 18*a* supported on the distal end of rod-shaped member 18. Rod-shaped member 18 is normally positioned in a posture indicated by the solid lines due to gravity, and causes guide roller 18*a* to apply a given stepping force to the film. When the film is drawn in at an increased speed by packaging mechanism 10C, rod-shaped member 18 is lifted against gravity.

The angular displacement of rod-shaped member 18 is detected by rotary encoder 17. When rotary encoder 17 detects the displacement of rod-shaped member 18 (i.e., when the speed at which the film is drawn in by packaging mechanism 10C is relatively high), the speed of rollers 85 of film supply mechanism 1 is increased.

Use of stepping roller 16 is advantageous in that it prevents the film from suffering undue force and also from sagging even if there is a difference between the speed at which the film is supplied from film supply mechanism 10A and the speed at which the film is drawn in by packaging mechanism 10C.

However, the free movement of guide roller 18*a* means that the length of the path of the film is uncertain. Consequently, stepping roller 16 may prevent the above advantages from being obtained even if the initial position of accumulating rollers 21 is changed according to the present exemplary embodiment. Such a drawback may be avoided by the following operation:

The problem is that distance Lx that is to be kept constant tends to fluctuate. Therefore, at least until the joining of the films is finished, rod-shaped member 18 should be maintained in a certain position (e.g., the position indicated by the solid lines in FIG. 12). As distance Lx is thus kept to a preset value at the time that the joining of the films is finished, there will no problem in carrying out the present invention.

For maintaining rod-shaped member 18 in a certain position until the joining of the films is finished, rod-shaped member 18 may be combined with a drive source, for example, and may be held immovable by the drive source while the films are being joined. A more simple alternative approach is that the speed for feeding the film with film packaging mechanism 10C may be lowered while the films are being joined to prevent rod-shaped member 18 from being lifted.

In the above exemplary embodiment, the initial position of accumulating rollers 21 is changed depending on the size of package bags thereby causing distance Lx to change. The present invention is not limited to such an arrangement. The initial position of stepping roller 16 may be changed depending on the size of package bags thereby causing distance Lx to change.

The invention claimed is:

1. A packaging apparatus comprising:

film supply means for joining the terminal end of a first film reeled out from a first film roll and the beginning end of a second film reeled out from a second film roll to each other, and for supplying said first and second films which are joined to each other as an elongate film; and packaging means for producing package bags of a given length by shaping said elongate film into a tubular form, vertically sealing the tubular form into a tubular film with a vertical sealing mechanism, horizontally sealing the tubular film with a horizontal sealing mechanism to produce a horizontally sealed portion at bottom of the tubular film, feeding a content into the tubular film, and thereafter horizontally sealing the bottomed tubular film again to produce a joined portion, thereby forming said package bags, filled with said content;

wherein said packaging apparatus further comprises:

distance adjusting means for changing the distance along said elongate film from a position, in which said first film and said second film are joined to each other to a position in which said tubular film is horizontally sealed, depending on the length of said package bag to be manufactured; and a stepping roller located prior to the packaging means, said stepping roller comprises a rod shaped member having one end pivotally supported and a guide roller supported on the distal end of the rod shaped end;

wherein said distance adjusting means comprises a film accumulator disposed between said film supply means and said packaging means, for guiding and holding said elongate film in a meandering fashion with a plurality of guide rollers; and said guide rollers include movable guide rollers for changing the length of said elongate film held in said film accumulator;

wherein said guide rollers include fixed guide rollers and said movable guide rollers which are movable toward and away from said fixed guide rollers; and said movable guide rollers automatically move to a preset position depending on the length of said package bag to be manufactured, wherein the distance Lx between the horizontally sealed portion and the joined portion is calculated as $Lx=pn+c$, where p is the length of the packaging bag, n is an integer corresponding to the number of package bags and c is a given length smaller than p.

2. The packaging apparatus according to claim 1, wherein said elongate film is horizontally trained around and extends between said fixed guide rollers and said movable guide rollers.

3. The packaging apparatus according to claim 1, wherein said vertical sealing mechanism vertically seals a region of said elongate film including said joint for a period of time which is longer than a normal vertically sealing time.

4. The packaging apparatus according to claim 3, wherein said region including said joint is vertically sealed after said film supply means has joined said first film and said second film to each other at a timing after a preset number of cycles have been calculated.

5. The packaging apparatus according to claim 1, wherein said packaging means continuously manufactures said package bag while said vertical sealing mechanism and said horizontal sealing mechanism is feeding said tubular film through a box motion process.

6. The packaging apparatus according to claim 5, wherein said movable guide rollers move at a constant speed toward said fixed guide rollers while said film supply means is joining said first film and said second film to each other.

7. A method for forming a film into a packaging bag comprising:

providing the packaging apparatus according to claim 1, setting the distance along said elongate film from a position, in which said first film and said second film are joined to each other to a position in which said tubular film is horizontally sealed, depending on the length of said package bag to be manufactured, to a length which is not integral multiple of said length; and maintaining the rod-shaped member in predetermined position during the joining of the films.

8. A method of forming a film into a packaging bags according to claim 7, wherein a vertical sealing time for the region including the film joint is longer than a sealing time for the region not including the film joint.

9. A method for packaging a material using the packaging apparatus according to claim 1, comprising:

reeling out a first elongate film from a first film roll;

reeling out a second elongate film from a second film roll;

joining a terminal end of the first film to a beginning end of the second film to each other within a film accumulator to form a joined elongate film;

shaping said joined elongate film into a tubular form;

vertically sealing the tubular form into a tubular film;

changing a length of said joined elongate film held in the film accumulator from a first length, in which said first film and said second film are joined to each other, to a second length, in which said tubular film is horizontally sealed;

horizontally sealing the tubular film to produce a bottom of the tubular film;

feeding the material into the tubular film; and horizontally sealing the tubular film again to produce a package bag filled with said material, wherein said second length is not an integral multiple of a length of said package bag.

* * * * *

UNITED STATES PATENT AND TRADEMARK OFFICE

CERTIFICATE OF CORRECTION

PATENT NO. : 7,934,361 B2
APPLICATION NO. : 12/089854
DATED : May 3, 2011
INVENTOR(S) : Orihiro Tsuruta et al.

It is certified that error appears in the above-identified patent and that said Letters Patent is hereby corrected as shown below:

Column 1, Line 2, above "TECHNICAL FIELD" insert --This application is the U.S. National Phase under 35 U.S.C. §371 of International Application PCT/JP2005/019193, filed October 19, 2005. The International Application was published under PCT Article 21(2) in a language other than English.--

Signed and Sealed this
Twenty-ninth Day of November, 2011

David J. Kappos

David J. Kappos
*Director of the United States Patent and Trademark Office*